US007017240B2

(12) United States Patent
Savicki

(10) Patent No.: US 7,017,240 B2
(45) Date of Patent: Mar. 28, 2006

(54) CLOSURE DEVICE

(75) Inventor: Alan F. Savicki, Oswego, IL (US)

(73) Assignee: The Glad Products Company, Oakland, CA (US)

( * ) Notice: Subject to any disclaimer, the term of this patent is extended or adjusted under 35 U.S.C. 154(b) by 10 days.

(21) Appl. No.: 10/466,882

(22) PCT Filed: Feb. 8, 2001

(86) PCT No.: PCT/US01/04014

§ 371 (c)(1),
(2), (4) Date: Jul. 21, 2003

(87) PCT Pub. No.: WO02/062672

PCT Pub. Date: Aug. 15, 2002

(65) Prior Publication Data

US 2004/0045134 A1 Mar. 11, 2004

(51) Int. Cl.
*A44B 19/00* (2006.01)
*B65D 33/16* (2006.01)

(52) U.S. Cl. ..... 24/387; 383/64; 383/65; 24/399; 24/400

(58) Field of Classification Search ..... 24/400, 24/399, 415, 390, 30.5 R, 387; 383/63, 64, 383/65; 29/408
See application file for complete search history.

(56) References Cited

U.S. PATENT DOCUMENTS

| | | | | |
|---|---|---|---|---|
| 3,790,992 | A * | 2/1974 | Herz | 24/400 |
| 3,806,998 | A | 4/1974 | Laguerre | |
| 4,262,395 | A * | 4/1981 | Kosky | 24/400 |
| 4,829,641 | A | 5/1989 | Williams | |
| 5,007,143 | A | 4/1991 | Herrington | |
| 5,077,143 | A | 12/1991 | Barraclough et al. | |
| 5,189,764 | A * | 3/1993 | Herrington et al. | 24/384 |
| 5,301,394 | A | 4/1994 | Richardson et al. | |
| 5,442,838 | A | 8/1995 | Richardson et al. | |
| 5,448,807 | A | 9/1995 | Herrington, Jr. | |
| 5,664,299 | A | 9/1997 | Porchia et al. | |
| 5,722,128 | A | 3/1998 | Toney et al. | |
| 5,836,056 | A | 11/1998 | Porchia et al. | |
| 5,871,281 | A | 2/1999 | Stolmeier et al. | |
| 5,950,285 | A | 9/1999 | Porchia et al. | |
| 5,956,815 | A | 9/1999 | O'Connor et al. | |
| 6,088,887 | A * | 7/2000 | Bois | 24/399 |
| 6,167,597 | B1 * | 1/2001 | Malin | 24/400 |
| 6,385,818 | B1 * | 5/2002 | Savicki, Sr. | 24/30.5 R |
| 6,595,689 | B1 * | 7/2003 | Borchardt et al. | 383/64 |

* cited by examiner

*Primary Examiner*—Jack W. Lavinder
(74) *Attorney, Agent, or Firm*—Thomas C. Feix

(57) ABSTRACT

A container (120) includes a closure device (121). The closure device includes interlocking fastening strips (130, 131) and a slider (132) slidably disposed on the fastening strips for facilitating the occlusion and deocclusion of the fastening strips. The slider includes a separator (133) that facilitates the deocclusion of the fastening strips. The container includes a seal (129) to provide a leak-proof closure by facilitating the occlusion of the closure device (121) after the slider (132) has been moved in the occlusion direction (114) and reached the end of the fastening strips. The seal (129) includes a curved portion that further facilitates the leak-proof closure. Additionally, a tactile indication that the closure device (121) has been fully occluded is given as the separator (133) passes over the seal (129). Similarly, an audible indication may also be provided. The seal may be accomplished by heat sealing, ultrasonic sealing or adhesives that attach the sidewalls together.

18 Claims, 10 Drawing Sheets

106
104
130
131
132
133
134
135
140
142
144
146

CLOSURE DEVICE

FIELD OF THE INVENTION

The present invention relates generally to closure devices and, more particularly, a closure device utilizing a slider with a separator and a seal to provide a leak-proof closure. The invention is particularly well suited for use on flexible storage containers, including plastic bags.

BACKGROUND OF THE INVENTION

The use of closure devices for fastening storage containers, including plastic bags, is generally known. Furthermore, the manufacture of closure devices made of plastic materials is generally known to those skilled in the art, as demonstrated by the numerous patents in this area.

A particularly well-known use for closure devices is in connection with flexible storage containers, such as plastic bags. In some instances, the closure device and the associated container are formed from thermoplastic materials, and the closure device and the sidewalls of the container are integrally formed by extrusion as a single piece. Alternatively, the closure device and sidewalls of the container may be formed as separate pieces and then connected by heat sealing or any other suitable connecting process. In either event, such closure devices are particularly useful in providing a closure means for retaining matter within the bag.

Conventional closure devices typically utilize mating fastening strips or closure elements, which are used to selectively seal the bag. A slider may be provided for use in opening and closing the fastening strips. Some of these sliders include a separator. When the slider is moved in the appropriate direction, the separator divides the fastening strips and opens the bag.

One of the difficulties involved in providing a slider with a separator is the tendency of the separator to force the deocclusion of the fastening strips at the closing end even after the container has been occluded. This situation is especially problematic if a full-length separator is used. With a full-length separator, the separator extends through the closure elements and thus a gap exists in the fastening strips wherein they are not occluded. In addition, the separator may force the deocclusion of the surrounding area.

Furthermore, it is often difficult for the user to determine that the container has been fully occluded. Specifically, the user may not be able to determine that the slider has reached the end position when the user is occluding the fastening strips.

The purpose of the present invention is to provide a container that is closable and sealable by means of a slider that includes a full length separator. The present invention would also provide an indication that the container has been fully occluded.

SUMMARY OF THE INVENTION

According to the teachings of the present invention, the closure device includes interlocking fastening strips and a slider slidably disposed on the interlocking fastening strips for facilitating the occlusion and deocclusion of the fastening strips when moved towards first and second ends of the fastening strips. The slider includes a separator that extends between the fastening strips. Specifically, the separator extends between the closure elements on the fastening strips.

The closure device includes a seal. The seal is disposed near one end of the closure device in order to prevent leakage when the closure device has been occluded. Additionally, the seal extends partially upward as to prevent the slider from moving unassisted after the closure device has been fully occluded. This design also provides a tactile indication that the container has been fully occluded as the user will "feel" the slider pass over the seal. Additionally, the movement of the flexible separator over the seal may also provide an audible indication of occlusion.

The present invention will become more readily apparent upon reading the following detailed description of exemplified embodiments and upon reference to the accompanying drawings herein.

While the present invention will be described and disclosed in connection with certain embodiments and procedures, the intent is not to limit the present invention to these embodiments and procedures.

DESCRIPTION OF THE EMBODIMENTS

Figure 1:
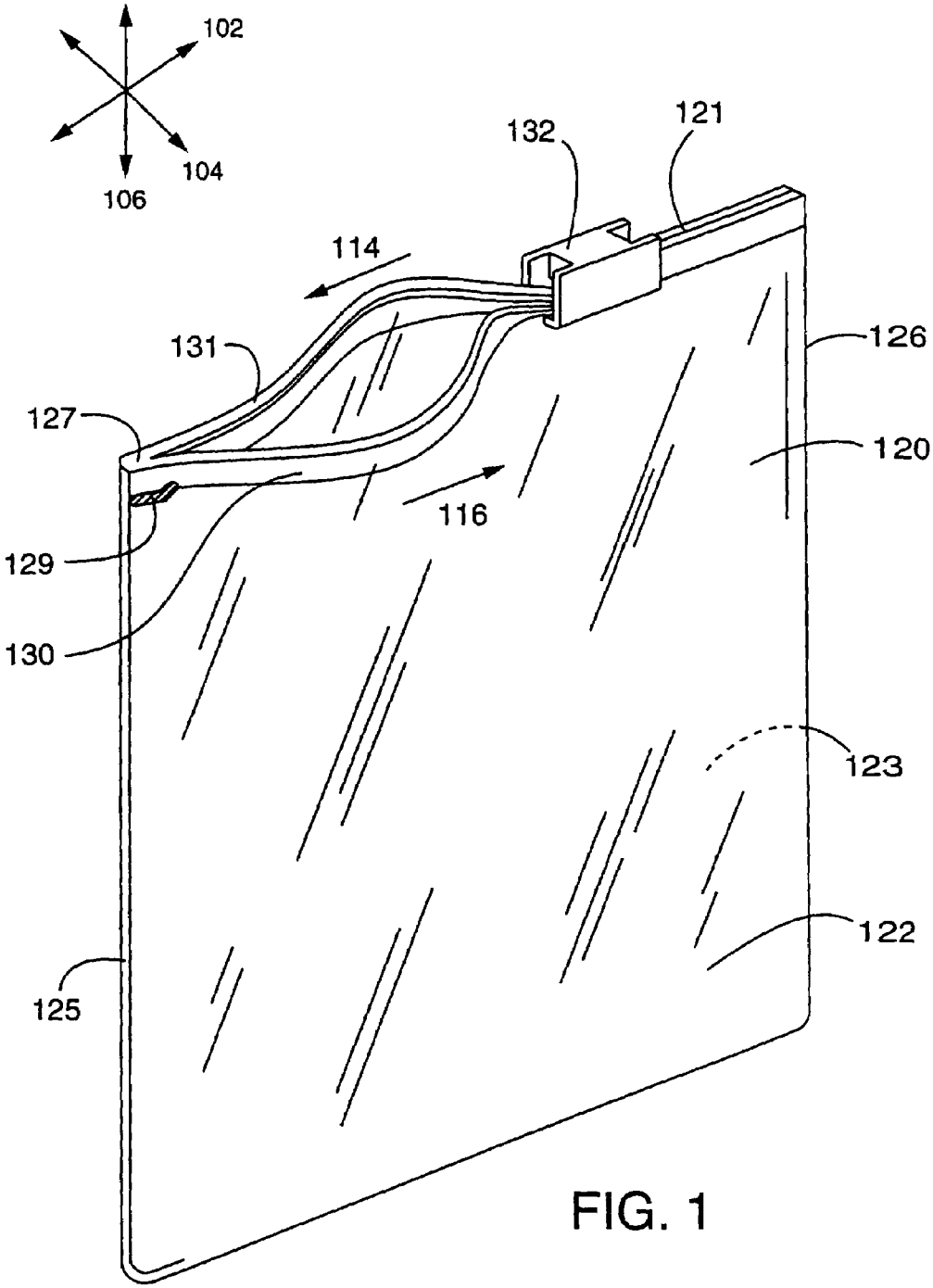
FIG. 1 is a perspective view of a container according to the present invention in the form of a plastic bag.

FIG. 1 illustrates an embodiment of a container in the form of a plastic bag 120 having a sealable closure device 121. The bag 120 includes a first sidewall 122 and a second sidewall 123 joined at first seals 125, 126 to define a compartment accessible through an open top end but sealable by means of the closure device 121. The bag 120 additionally includes a seal 129 disposed near a first end 127.

The closure device 121 includes first and second fastening strips 130, 131 and a slider 132. The fastening strips 130, 131 and the slider 132 have a longitudinal X axis 102, a transverse Y axis 104 and a vertical Z axis 106. The transverse Y axis 104 is perpendicular to the longitudinal X axis 102. The vertical Z axis 106 is perpendicular to the longitudinal X axis 102 and the vertical Z axis 106 is perpendicular to the transverse Y axis 104.

The first fastening strip 130 is attached to the first sidewall 122 near the top end of the bag 120. The second fastening strip 131 is attached to the second sidewall 123 near the top end of the bag 120. The fastening strips 130, 131 are located across from and substantially parallel to each other and are configured to allow the fastening strips 130, 131 to be able to interlock. The slider 132 is mounted onto the fastening strips 130, 131 so that the slider 132 is restrained from being removed from the fastening strips 130, 131 in the Z axis 106 but free to slide along the X axis 102. The slider 132 engages the fastening strips 130, 131 so that when the slider 132 moves in an occlusion direction 114, the fastening strips 130, 131 interlock and the bag 120 is sealed, and when the slider 132 moves in a deocclusion direction 116, the fastening strips 130, 131 separate and the bag 120 is open.

Figure 2:
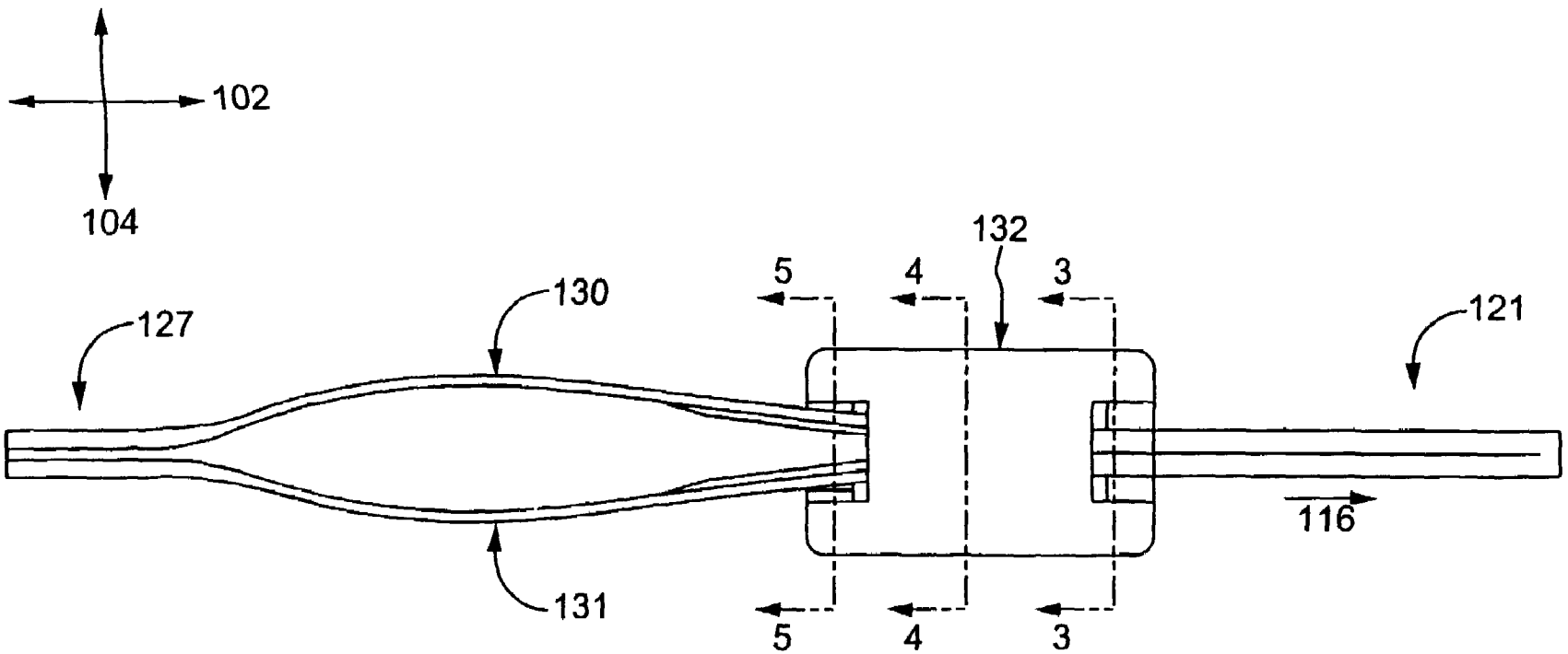
FIG. 2 is a top view of the container in FIG. 1.
Figures 3, 4, 5:
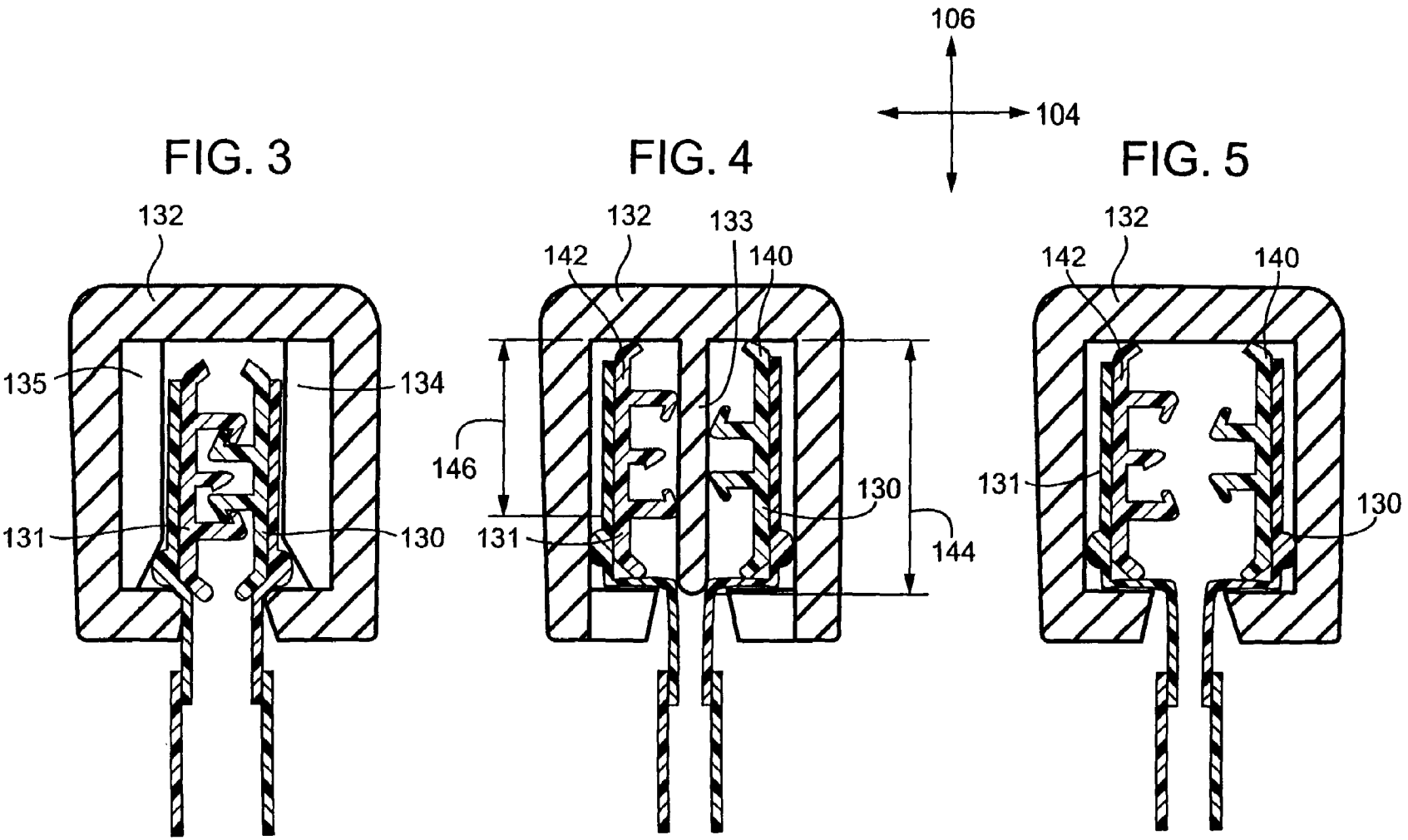
FIG. 3 is a cross-sectional view taken along line 3—3 in FIG. 2.
FIG. 4 is a cross-sectional view taken along line 4—4 in FIG. 2.
FIG. 5 is a cross-sectional view taken along line 5—5 in FIG. 2.

FIG. 2 illustrates a top view of the closure device in FIG. 1. The slider 132 is shown disengaging the fastening strips 130, 131. FIGS. 3–5 depict cross sections taken at three separate locations along the slider 132 as shown in FIG. 2.

FIG. 3 illustrates a cross section taken at a location along the slider 132 wherein the fastening strips 130, 131 are occluded. The slider is shown with a first and second occlusion members 134, 135. The occlusion members 134, 135 facilitate the occlusion of the fastening strips 130, 131 by applying pressure to the sides of the fastening strips 130, 131 as the slider is moved in the occlusion direction.

FIG. 4 illustrates a cross section taken at a location along the slider 132 wherein the fastening strips 130, 131 are being deoccluded. The slider 132 includes a separator 133. The separator 133 facilitates the deocclusion of the fastening strips 130, 131 by forcing the fastening strips 130, 131 to disengage.

The separator 133 extends between the fastening strips 130, 131. Furthermore, the separator 133 may extend between the closure elements 140, 142. In this embodiment, the separator 133 has a length 144 in the Z axis 106 which is greater than the length 146 in the Z axis 106 of the closure elements. In other embodiments, the length of the separator may be equal to or less than the length of the closure elements. In addition, the separator may be flexible.

FIG. 5 illustrates a cross section taken at a location along the slider 132 wherein the fastening strips 130, 131 have been deoccluded.

Figure 6:
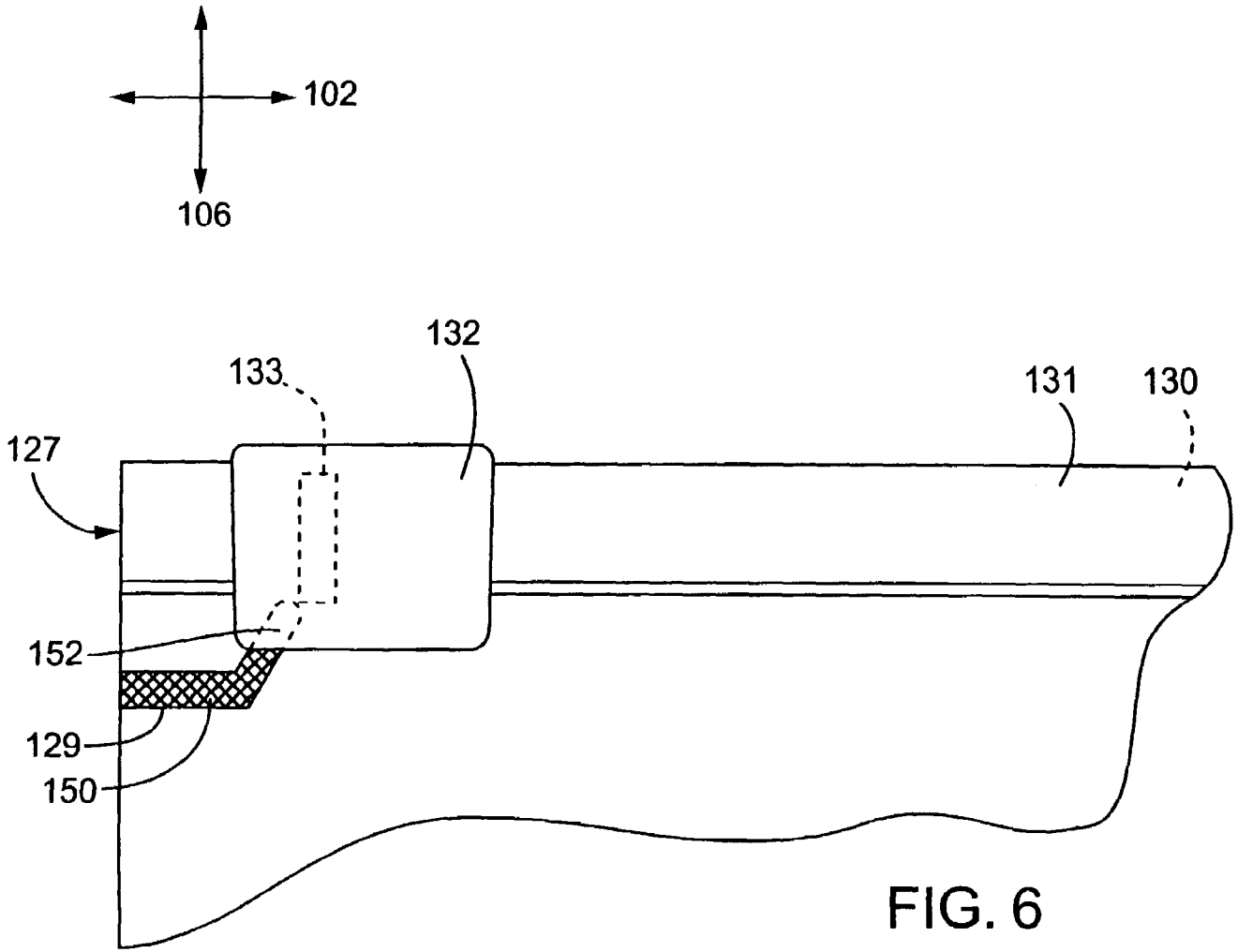
FIG. 6 is a partial side view of the container in FIG. 1 showing the separator prior to engaging the seal.
Figure 7:
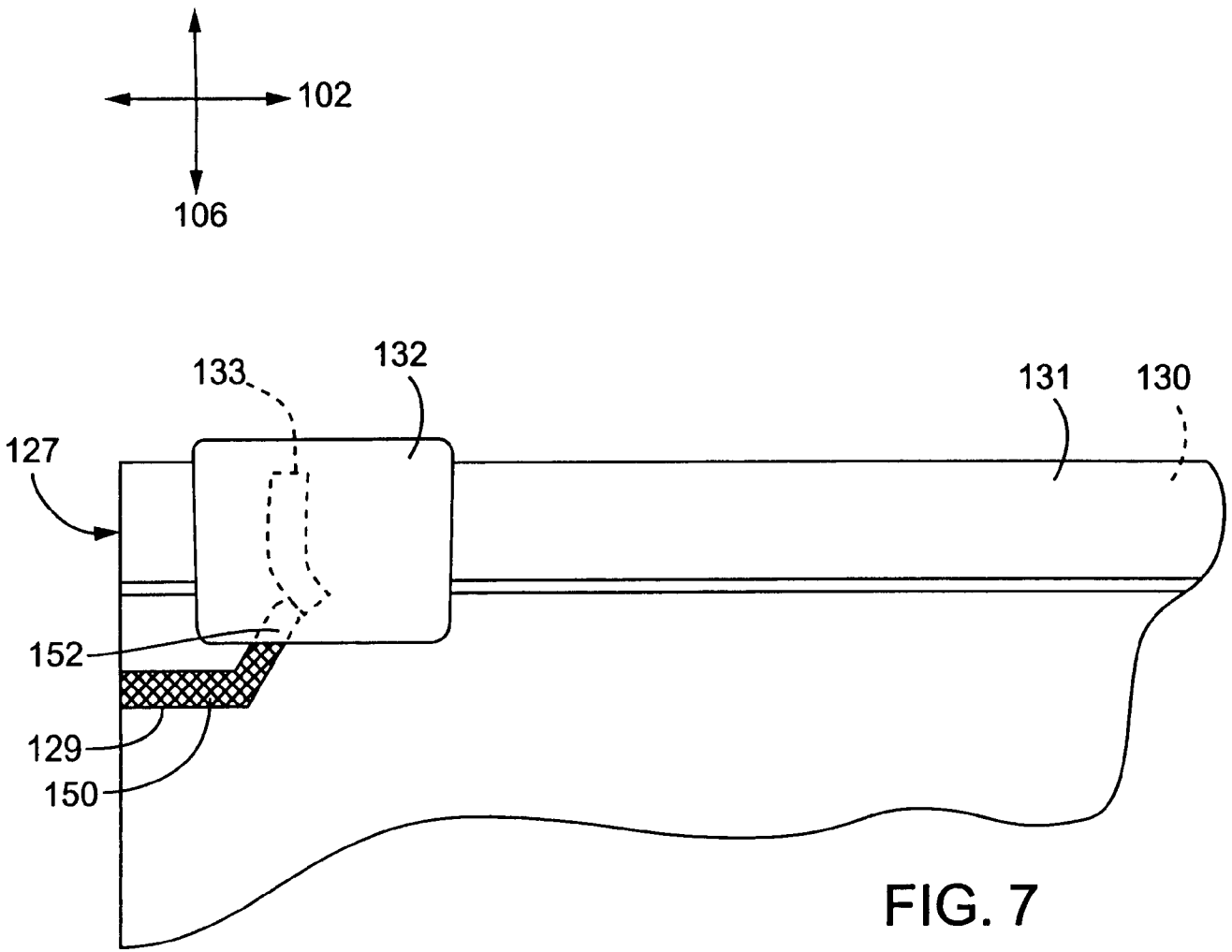
FIG. 7 is a partial side view of the container in FIG. 1 showing the separator engaging the seal.
Figure 8:
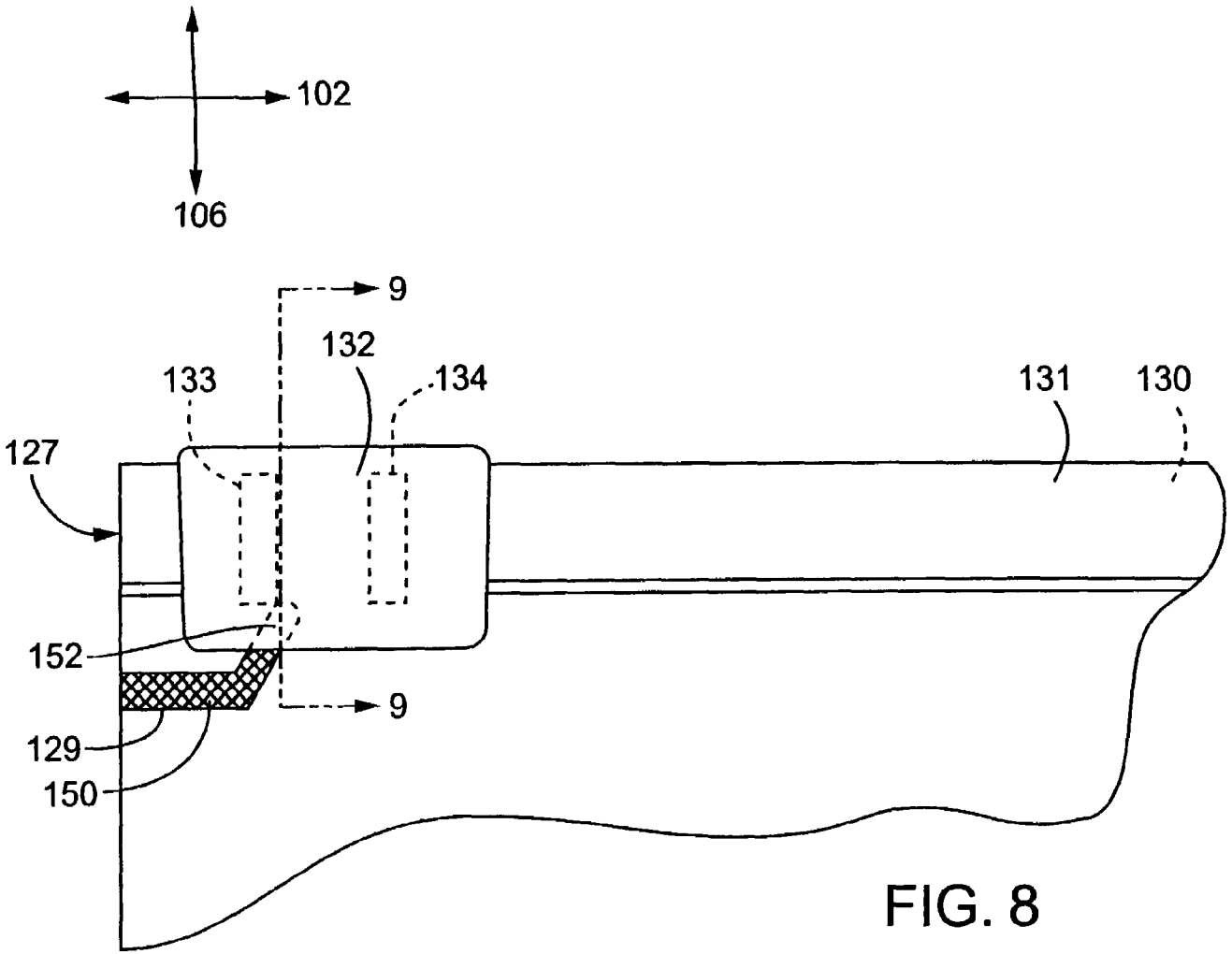
FIG. 8 is a partial side view of the container in FIG. 1 showing the separator after engaging the seal.

FIGS. 6–8 depict partial front views of the container in FIG. 1 and illustrate the separator 133 moving over the seal 129. The seal is disposed near the first end 127 and below the closure elements 140, 142. The seal 129 engages the separator 133 as the slider 132 is moved to the first end 127. The seal 129 may include a horizontal portion 150 and an angled portion 152.

FIG. 6 illustrates the slider 132 positioned such that the separator 133 is positioned prior to engaging the seal 129. The separator 133 has a first position as shown in FIG. 6.

FIG. 7 illustrates the slider 132 positioned such that the separator 133 is passing over the seal 129. The separator 133 bends in response to a force applied to the slider 132 which is needed in order for the separator 133 to pass over the seal 129. The separator 133 has a second position as shown in FIG. 7. The return of the separator 133 to the first position after the separator 133 has passed the seal 129, would provide a tactile indication that the closure device has been fully occluded. In addition, an audible indication may also be heard.

FIG. 8 illustrates the slider 132 positioned at the first end 127. The separator 133, having just passed over the angled portion 152 of the seal 129, returns to the first position. In this end position, the fastening strips 130, 131 have been fully occluded. Additionally, the separator 133 will be unable to move unassisted beyond the seal 129 and thus, the slider 132 will remain in the end position.

Figure 9:
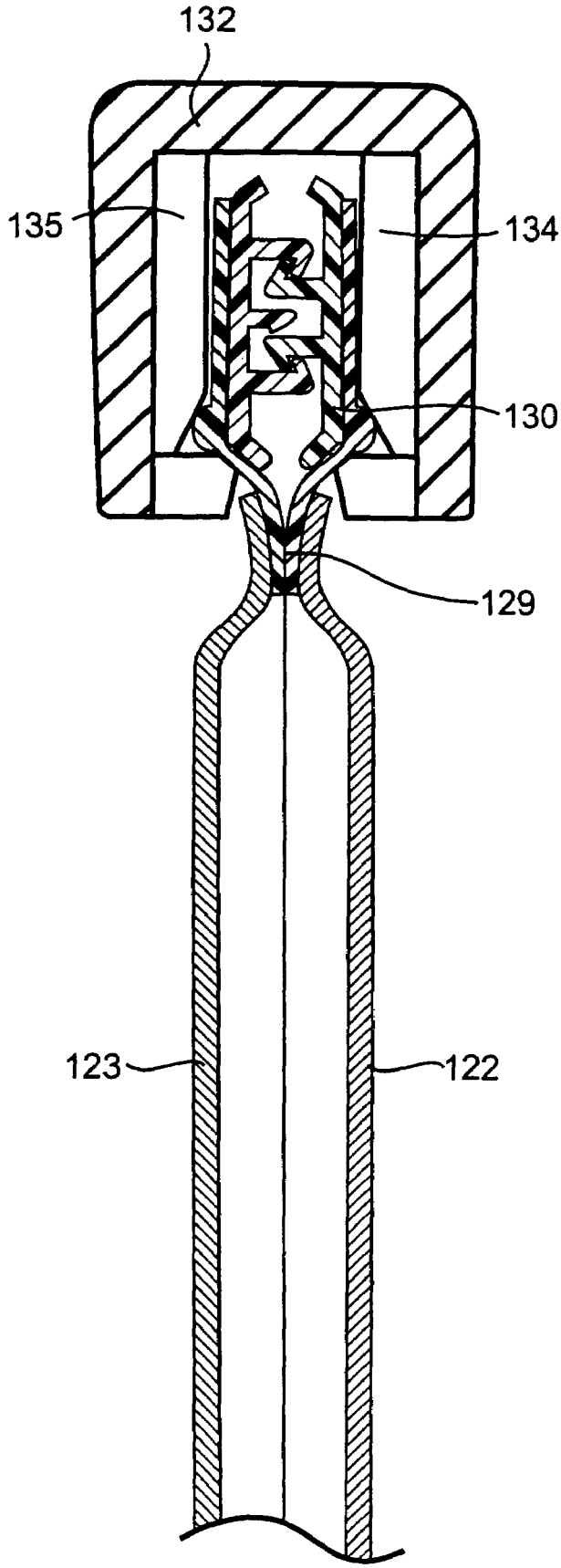
FIG. 9 is a cross-sectional view taken along line 9—9 in FIG. 8.

FIG. 9 illustrates a cross-section view of the slider 132 and fastening strips 130, 131 at a location on the slider 132 after the separator 133 has passed over the seal 129 and the fastening strips 130, 131 have been occluded. The occlusion members 134, 135 are shown engaging the fastening strips beyond the seal 129 as shown in FIGS. 8 and 9. As a result, the fastening strips are occluded beyond the seal 129. The seal 129 prevents air, liquids or other items from entering and leaving the container. This creates a leak-proof closure.

In keeping with a general aspect of the present invention and as will be described in greater detail below, the interlocking fastening strips of the present invention may be of various types or forms.

Figure 10:
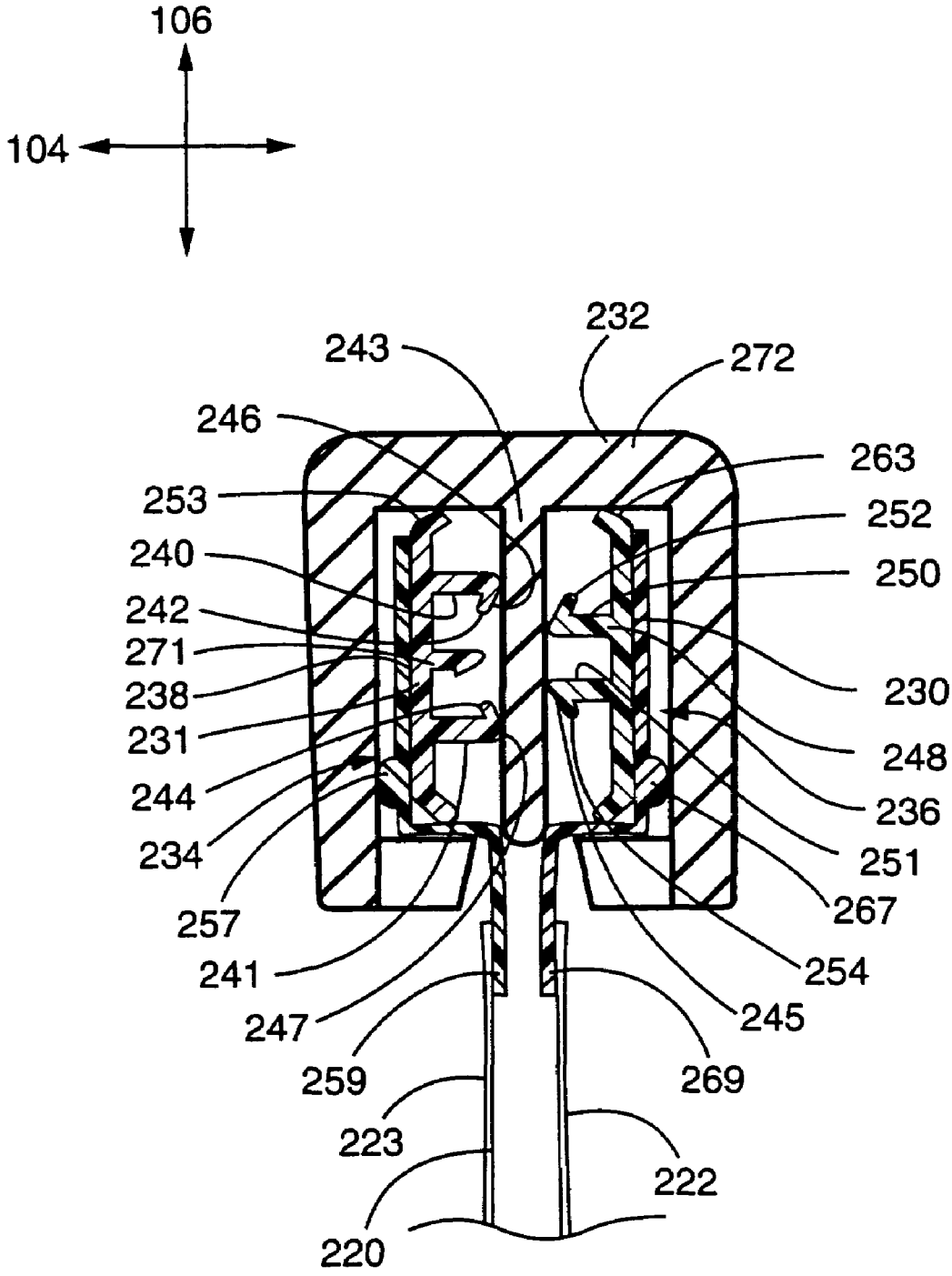
FIG. 10 is a cross-sectional view of the fastening strips.

As shown in FIG. 10, the fastening strips may be U-channel fastening strips as described in U.S. Pat. No. 4,829,641. U-channel fastening strips include a first fastening strip 230 with a first closure element 236 and a second fastening strip 231 with a second closure element 234. The first closure element 236 engages the second closure element 234. The first fastening strip 230 may include a flange 263 disposed at the upper end of the first fastening strip 230 and a rib 267 disposed at the lower end of the first fastening strip 230. The first fastening strip 230 may include a flange portion 269. Likewise, the second fastening strip 231 may include a flange 253 disposed at the upper end of the second fastening strip 231 and a rib 257 disposed at the lower end of the second fastening strip 231. The second fastening strip 231 may include a flange portion 259. The side walls 222, 223 of the plastic bag 220 may be attached to the fastening strips 230, 231 by conventional manufacturing techniques.

The second closure element 234 includes a base portion 238 having a pair of spaced-apart parallely disposed webs 240, 241, extending from the base portion 238. The base and the webs form a U-channel closure element. The webs 240, include hook closure portions 242, 244 extending from the webs 240, 241 respectively, and facing towards each other. The hook closure portions 242, 244 include guide surfaces 246, 247 which serve to guide the hook closure portions 242, 244 for occluding with the hook closure portions 252, 254 of the first closure element 236.

The first closure element 236 includes a base portion 248 including a pair of spaced-apart, parallely disposed webs 250, 251 extending from the base portion 248. The base and the webs form a U-channel closure element. The webs 250, 251 include hook closure portions 252, 254 extending from the webs 250, 251 respectively and facing away from each other. The hook closure portions 252, 254 include guide surfaces 245, 255, which generally serve to guide the hook closure portions 252, 254 for occlusion with the hook closure portions 242, 244 of the second closure element 234. The guide surfaces 245, 255 may also have a rounded crown surface.

The slider 232 includes a top portion 272. The top portion provides a separator 243 having a first end and a second end wherein the first end may be wider than the second end. In addition, the separator 243 may be triangular in shape. When the slider is moved in the occlusion direction, the separator 243 deoccludes the fastening strips 230, 231 as shown in FIG. 10. Referring to FIG. 10, the closure elements 234, 236 are deoccluded and specifically, the upper hook portions 242, 252 and the lower hook portions 244, 254 are deoccluded.

Figure 11:
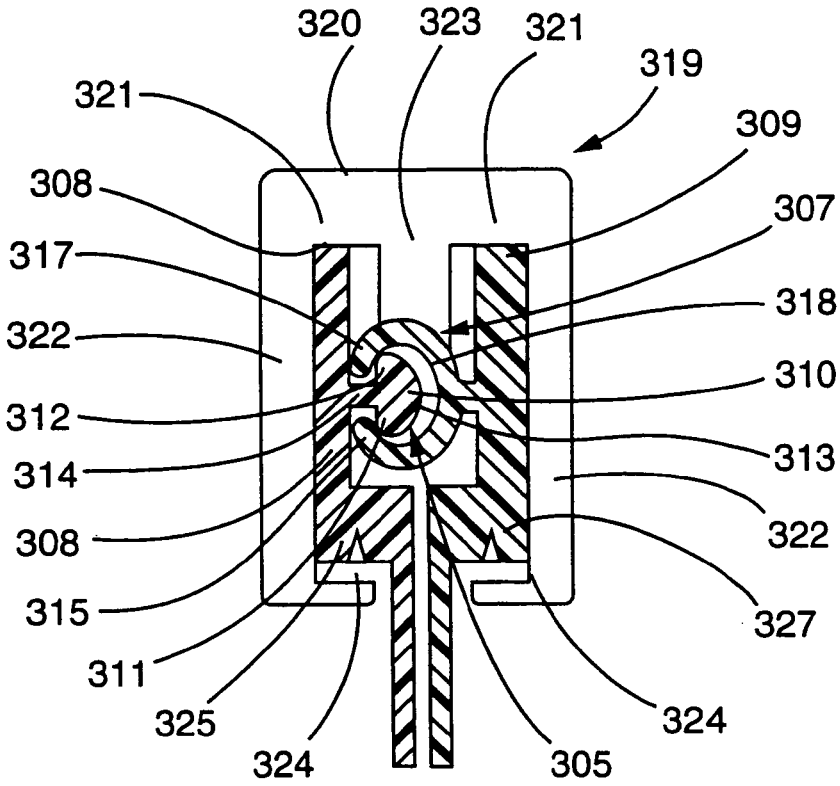
FIG. 11 is a cross-sectional view of another embodiment.

The interlocking fastening strips may comprise "arrowhead-type" or "rib and groove" fastening strips as shown in FIG. 11 and as described in U.S. Pat. No. 3,806,998. The rib element 305 interlocks with the groove element 307. The rib element 305 is of generally arrow-shape in transverse cross section including a head 310 comprising interlock shoulder hook portions 311 and 312 generally convergently related to provide a cam ridge 313 generally aligned with a stem flange 314 by which the head is connected in spaced relation with respect to the supporting flange portion 308. (U.S. Pat. No. 3,806,998, Col. 2, lines 16–23). At their surfaces nearest the connecting stem flange 314, the shoulder portions 311 and 312 define reentrant angles therewith providing interlock hooks engageable with interlock hook flanges 315 and 317 respectively of the groove element 307. (U.S. Pat. No. 3,806,998, Col. 2, lines 23–28). Said hook flanges generally converge toward one another and are spread open to receive the head 310 therebetween when said head is pressed into said groove element 307 until the head is fully received in a groove 318 of said groove element 307 generally complementary to the head and within which the head is interlocked by interengagement of the head shoulder hook portions 311 and 312 and the groove hook flanges 315 and 317. (U.S. Pat. No. 3,806,998, Col. 2, lines 28–36). Through this arrangement, as indicated, the head and groove elements 305 and 307 are adapted to be interlockingly engaged by being pressed together and to be separated when forcably pulled apart, as by means of a generally U-shaped slider 319. (U.S. Pat. No. 3,806,998, Col. 2, lines 36–41).

The slider 319 includes a flat back plate 320 adapted to run along free edges 321 on the upper ends of the sections of the flange portions 308 and 309 as shown in the drawing. (U.S. Pat. No. 3,806,998, Col. 2, lines 41–46). Integrally formed with the back plate 320 and extending in the same direction (downwardly as shown) therefrom are respective coextensive side walls 322 with an intermediate spreader finger 323 extending in the same direction as the side walls at one end of the slider. (U.S. Pat. No. 3,806,998, Col. 2, lines 46–51). The side walls 322 are in the form of panels which are laterally divergent from a narrower end of the slider. (U.S. Pat. No. 3,806,998, Col. 2, lines 51–55). The slider walls 322 are each provided with an inwardly projecting shoulder structure 324 flange adapted to engage respective shoulder ribs 325 and 327 on respectively outer sides of the lower section of the flange portions 308 and 309. (U.S. Pat. No. 3,806,998, Col. 2, line 66 to Co. 3, line 3).

Figure 12:
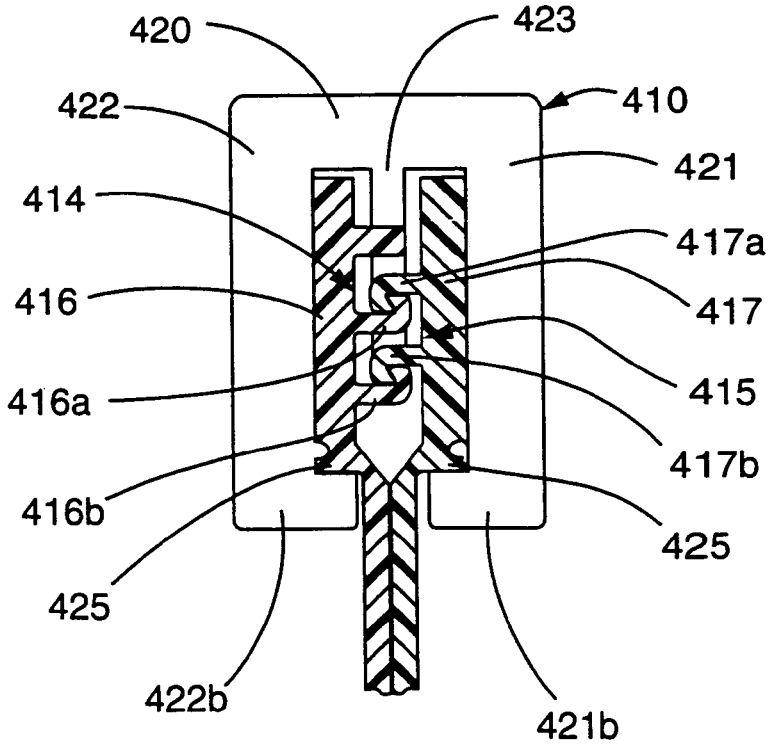
FIG. 12 is a cross-sectional view of another embodiment.

Additionally, the interlocking fastening strips may comprise "profile" fastening strips, as shown in FIG. 12 and described in U.S. Pat. No. 5,664,299. As shown in FIG. 12, the first profile 416 has at least an uppermost closure element 416*a* and a bottommost closure element 416*b*. (U.S. Pat. No. 5,664,299, Col. 3, lines 25–27). The closure elements 416*a* and 416*b* project laterally from the inner surface of strip 414. (U.S. Pat. No. 5,664,299, Col. 3, lines 27–28). Likewise, the second profile 417 has at least an uppermost closure element 417*a* and a bottommost closure element 417*b*. (U.S. Pat. No. 5,664,299, Col. 3, lines 28–30). The closure elements 417*a* and 417*b* project laterally from the inner surface of strip 415. (U.S. Pat. No. 5,664,299, Col. 3, lines 30–32). When the bag is closed, the closure elements of profile 416 interlock with the corresponding closure elements of profile 417. (U.S. Pat. No. 5,664,299, Col. 3, lines 32–34). As shown in FIG. 12, closure elements 416*a*, 416*b*, 417*a* and 417*b* have hooks on the ends of the closure elements, so that the profiles remain interlocked when the bag is closed, thereby forming a seal. (U.S. Pat. No. 5,664,299, Col. 3, lines 34–37).

The straddling slider 410 comprises an inverted U-shaped member having a top 420 for moving along the top edges of the strips 414 and 415. (U.S. Pat. No. 5,664,299, Col. 4, lines 1–3). The slider 410 has side walls 421 and 422 depending from the top 420. (U.S. Pat. No. 5,664,299, Col. 4, lines 3–4). A separating leg 423 depends from the top 420 between the side walls 421 and 422 and is located between the uppermost closure elements 416*a* and 417*a* of profiles 416 and 417. (U.S. Pat. No. 5,664,299, Col. 4, lines 26–30). The fastening assembly includes ridges 425 on the outer surfaces of the fastening strips 414 and 415, and shoulders 421*b* and 422*b* on the side walls of the slider. (U.S. Pat. No. 5,664,299, Col. 4, lines 62–65). The shoulders act as means for maintaining the slider in straddling relation with the fastening strips by grasping the lower surfaces of the ridges 425. (U.S. Pat. No. 5,664,299, Col. 5, lines 4–7).

Figure 13:
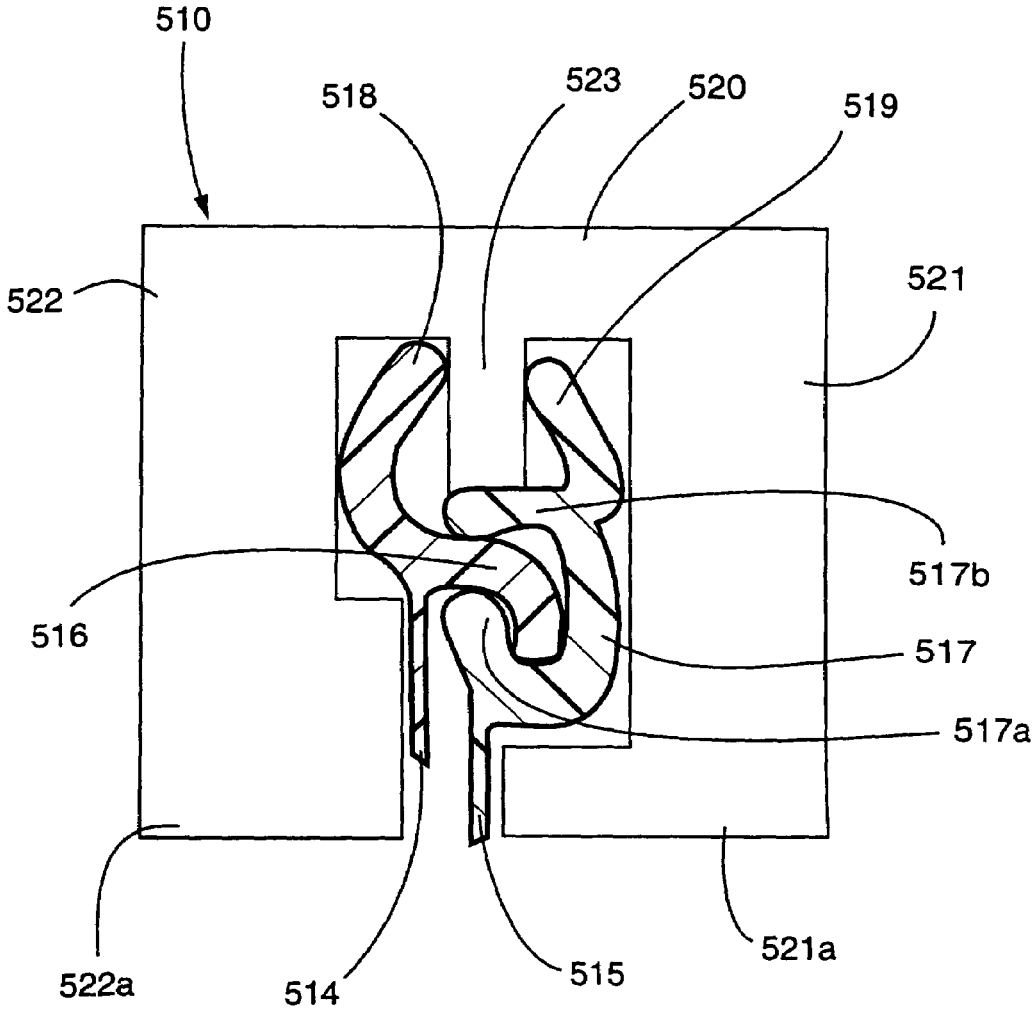
FIG. 13 is a cross-sectional view of another embodiment.

Also, the interlocking fastening strips may be "rolling action" fastening strips as shown in FIG. 13 and described in U.S. Pat. No. 5,007,143. The strips 514 and 515 include profiled tracks 518 and 519 extending along the length thereof parallel to the rib and groove elements 516 and 517 and the rib and groove elements 516, 517 have complimentary cross-sectional shapes such that they are closed by pressing the bottom of the elements together first and then rolling the elements to a closed position toward the top thereof. (U.S. Pat. No. 5,007,143, Col. 4, line 62 to Col. 5, line 1). The rib element 516 is hook shaped and projects from the inner face of strip 514. (U.S. Pat. No. 5,007,143, Col. 5, lines 1–3). The groove element 517 includes a lower hook-shaped projection 517*a* and a relatively straight projection 517*b* which extend from the inner face of strip 515. (U.S. Pat. No. 5,007,143, Col. 5, lines 3–6). The profiled tracks 518 and 519 are inclined inwardly toward each other from their respective strips 514 and 515. (U.S. Pat. No. 5,007,143, Col. 5, lines 6–8).

The straddling slider 510 comprises an inverted U-shaped plastic member having a back 520 for moving along the top edges of the tracks 518 and 519 with side walls 521 and 522 depending therefrom for cooperating with the tracks and extending from an opening end of the slider to a closing end. (U.S. Pat. No. 5,007,143, Col. 5, lines 26–31). A separator finger 523 depends from the back 520 between the side walls 521 and 522 and is inserted between the inclined tracks 518 and 519. (U.S. Pat. No. 5,007,143, Col. 5, lines 34–36). The slider 510 has shoulders 521*a* and 522*a* projecting inwardly from the depending side walls 521 and 522 which are shaped throughout the length thereof for cooperation with the depending separator finger 523 in creating the rolling action in opening and closing the reclosable interlocking rib and groove profile elements 516 and 517. (U.S. Pat. No. 5,007, 143, Col. 5, lines 43–49).

Although several interlocking fastening strip embodiments have been specifically described and illustrated herein, it will be readily appreciated by those skilled in the art that other kinds, types, or forms of fastening strips may be used without departing from the scope or spirit of the present invention.

The interlocking fastening strips may be manufactured by extrusion through a die. The interlocking fastening strips may be formed from any suitable thermoplastic material including, for example, polyethylene, polypropylene, nylon, or the like, or from a combination thereof. Thus, resins or mixtures of resins such as high density polyethylene, medium density polyethylene, and low density polyethylene may be employed to prepare the interlocking fastening strips. For example, the fastening strips may be made from low density polyethylene.

When the fastening strips are used in a sealable bag, the fastening strips and the films that form the body of the bag may be conveniently manufactured from heat sealable material. In this way, the bag may be economically formed by using an aforementioned thermoplastic material and by heat sealing the fastening strips to the bag. For example, the bag may be made from a mixture of high pressure, low density polyethylene and linear, low density polyethylene.

The fastening strips may be manufactured by extrusion or other known methods. For example, the closure device may be manufactured as individual fastening strips for later attachment to the bag or may be manufactured integrally with the bag. In addition, the fastening strips may be manufactured with or without flange portions on one or both of the fastening strips depending upon the intended use of the fastening strips or expected additional manufacturing operations.

The fastening strips can be manufactured in a variety of forms to suit the intended use. The fastening strips may be integrally formed on the opposing sidewalls of the container or bag, or connected to the container by the use of any of many known methods. For example, a thermoelectric device may be applied to a film in contact with the flange portion of the fastening strips or the thermoelectric device may be applied to a film in contact with the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding is done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips should usually be positioned on the film in a generally parallel relationship with respect to each other, although this will depend on the intended use.

The seal may be created by heat sealing, ultrasonic sealing or an adhesive that attaches the sidewalls of the storage container together.

The slider may be multiple parts and snapped together. In addition, the slider may be made from multiple parts and fused or welded together. The slider may also be a one piece construction. The slider can be colored, opaque, translucent or transparent. The slider may be injection molded or made by any other method. The slider may be molded from any suitable plastic material, such as, nylon, polypropylene, polystyrene, acetal, toughened acetal, polyketone, polybutylene terrephthalate, high density polyethylene, polycarbonate or ABS (acrylonitrile-butadiene-styrene).

From the foregoing it will be understood that modifications and variations may be effectuated to the disclosed structures—particularly in light of the foregoing teachings—without departing from the scope or spirit of the present invention. As such, no limitation with respect to the specific embodiments described and illustrated herein is intended or should be inferred. In addition, all references and copending applications cited herein are hereby incorporated by reference in their entireties.

What is claimed is:

1. A closure device comprising:

first and second fastening strips arranged to be interlocked between first and second ends, wherein the first fastening strip includes a first closure element, the second fastening strip includes a second closure element;

a slider adapted to be slidably disposed on said fastening strips and facilitating the occlusion of said fastening strips when moved towards the first end, the slider includes a separator, the separator facilitating the deocclusion of said fastening strips when moved towards the second end;

the fastening strips include a first seal located below said first and second closure elements near the first end, the separator cooperates with the first seal to provide a seal along the fastening strips at the first end, wherein the separator engages the first seal when the slider is moved to the first end and wherein the slider provides an audible indication as the separator disengages the first seal.

2. The invention as in claim 1 wherein the separator has a first length and the closure elements have a second length.

3. The invention as in claim 2 wherein the first length is greater than the second length.

4. The invention as in claim 2 wherein the first length is equal to the second length.

5. The invention as in claim 2 wherein the first length is less than the second length.

6. The invention as in claim 1 wherein the separator deflects when the separator engages the first seal.

7. The invention as in claim 1 wherein the slider provides a tactile indication as separator engages the first seal.

8. The invention as in claim 1 wherein the first seal has an angled portion.

9. The invention as in claim 1 wherein the first seal has a horizontal portion.

10. The invention as in claim 1 wherein the first seal is manufactured by heat sealing.

11. The invention as in claim 1 wherein the first seal is manufactured by ultrasonic sealing.

12. The invention as in claim 1 wherein the first seal is manufactured using adhesive.

13. The invention as in claim 1 wherein the fastening strips comprise U-channel type fastening strips.

14. The invention as in claim 1 wherein the fastening strips comprise arrowhead type fastening strips.

15. The invention as in claim 1 wherein the fastening strips comprise profile type fastening strips.

16. The invention as in claim 1 wherein the fastening strips comprise rolling action type fastening strips.

17. A container comprising:

first and second sidewalls joined at seams to form a compartment with an opening;

first and second interlocking fastening strips respectively connected to the first and second sidewalls at the opening, the fastening strips being arranged to be interlocked between first and second ends, wherein the first fastening strip includes a first closure element, the second fastening strip includes a second closure element;

a slider slidably disposed on the fastening strips for movement between the first and second ends, the slider facilitating occlusion of the fastening strips when moved towards the first end, the slider includes a separator, the separator facilitating the deocclusion of the fastening strips when moved towards the second end; and the fastening strips include a first seal located below said first and second closure elements near the first end, the separator cooperates with the first seal to provide a seal along the fastening strips at the first end, wherein the separator engages the first seal when the slider is moved to the first end and wherein the slider provides an audible indication as the separator disengages the first seal.

18. A method of manufacturing a closure device, comprising:

providing first and second interlocking fastening strips arranged to be interlocked between first and second ends; and providing a slider slidably disposed on the fastening strips for movement between the first and second ends, the slider facilitating occlusion of the fastening strips when moved towards the first end, the slider includes a separator, the separator facilitating the deocclusion of the fastening strips when the slider is moved towards the second end the fastening strips include a first seal near the first end, the separator cooperates with the first seal to provide a seal along the fastening strips at the first end wherein the separator engages the first seal when the slider is moved to the first end and wherein the slider provides an audible indication as the separator disengages the first seal.

* * * * *